US006578497B2

(12) United States Patent
Reddig

(10) Patent No.: US 6,578,497 B2
(45) Date of Patent: Jun. 17, 2003

(54) WORK SURFACE STORAGE SYSTEM WITH REMOVABLE CONTAINERS

(75) Inventor: Ralph Reddig, Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/905,852

(22) Filed: Jul. 13, 2001

(65) Prior Publication Data

US 2003/0010259 A1 Jan. 16, 2003

(51) Int. Cl.[7] ..... A47B 85/00
(52) U.S. Cl. ..... 108/26
(58) Field of Search ..... 108/25, 26, 26.2, 108/50.11

(56) References Cited

U.S. PATENT DOCUMENTS 441,913 A * 12/1890 Wiesbauer
484,718 A * 10/1892 Isaacs
498,064 A * 5/1893 Korb et al.
583,943 A * 6/1897 Rayman
2,557,801 A * 6/1951 Shapiro
2,683,639 A * 7/1954 Brenny
D387,583 S * 12/1997 Shear
5,913,269 A * 6/1999 Franssen et al.
5,975,628 A * 11/1999 Russell
D458,084 S * 6/2002 Hudson

FOREIGN PATENT DOCUMENTS

DE 4212639 A1 * 8/1992

* cited by examiner

*Primary Examiner*—Jose V. Chen
(74) *Attorney, Agent, or Firm*—Flynn, Thiel, Boutell & Tanis, P.C.

(57) ABSTRACT

A work surface storage system is provided having a work surface with a hook and loop connector material on the bottom surface thereof and a plurality of storage containers which are suspended from the connector material. The work surface and connector material are translucent to permit viewing of the contents of the storage containers by looking downwardly through the work surface.

20 Claims, 2 Drawing Sheets

WORK SURFACE STORAGE SYSTEM WITH REMOVABLE CONTAINERS

FIELD OF THE INVENTION

The invention relates to a work surface storage system and, more particularly, to a work surface storage system having separate containers which store office supplies therein and are removably secured to a work surface to permit selective access to the containers.

BACKGROUND OF THE INVENTION

Office areas typically are subdivided into multiple workstations wherein each workstation is provided with a work surface for use by an office worker. It is well known to provide such work surfaces on freestanding bases, for example, to form a table. Also, many office areas are subdivided by freestanding wall panels wherein a work surface may be connected to or suspended from such a wall panel.

To facilitate the organization and flow of work on a work surface, such work surfaces typically include storage systems for the storage of articles therein. It is well known to provide such work surfaces with pullout drawers on which to store papers and office supplies. Such pullout drawers may be subdivided internally into compartments to separate the different types of office supplies being stored therein although such subdivided drawers may still permit unwanted mixing of the office supplies which may occur as a result of careless placement of the office supplies within the partitions by the office worker or possibly by shifting of the supplies during opening and closing of the drawer. Furthermore, since multiple drawers are provided which are fully enclosed by the work surface unit, an office worker may ultimately open several drawers before locating the desired office supply.

Additionally, such drawer structures typically are supported in a support frame which projects downwardly from a bottom of the work surface. The support frame thereby reduces the vertical clearance space or knee space between the floor and the bottom of the work surfaces into which clearance space the legs of the user must almost be placed. Thus, a drawer located directly in the knee space of the work surface may ultimately interfere with the office worker's legs. Additionally, the location of each drawer is typically limited to a single predefined location.

It is an object of the invention to provide an improved work surface arrangement and a storage system therefor which overcomes disadvantages associated with prior systems.

The invention relates to a work surface storage system with removable containers. The storage system includes a work surface which may be mounted on a freestanding base, supported on an existing wall structure such as a wall panel, or supported in other conventional arrangements. The work surface defines an open clearance space between a bottom face of the work surface and a floor which clearance space thereby defines a knee space that accommodates the legs of a user seated adjacent to the work surface.

The storage system further includes a plurality of storage containers which are removably connectable to the bottom face of the work surface wherein each container is adapted to receive office supplies therein. The storage containers are mounted on the work surface through a connector arrangement which permits ready removal of the storage containers but also permits the storage containers to be placed at substantially any desired location across the bottom work surface face which thereby provides significant flexibility in placing the individual storage containers in convenient locations for use by the office worker.

More particularly, the connection system comprises a layer of a connector material which preferably is a hook and loop material known commercially as Velcro™. The connector material is applied to substantially the entire bottom face of the work surface to maximize the attachment area to which the storage containers may be attached. The storage containers are outfitted with a similar mating connector material, namely a hook and loop material which is mateable with the corresponding connector material on the bottom work surface face.

Each storage container includes a flange extending about the entire upper rim of the storage container to which an annular strip of the connector material is applied. Thus, the storage container may be affixed to the hook and loop material on the bottom work surface face at any desired location.

The storage container contains a hollow interior storage space in which the office supplies may be stored. To permit removal of the storage containers from the work surface, a tab is provided on the rim which projects outwardly from the flange in cantilevered relation therewith. When the entire rim is fixed to the work surface, the tab still hangs free and may be gripped by the hand of the office worker to allow for pulling of the storage container downwardly which effects disengagement of the hook and loop materials on the work surface and the storage container.

To further facilitate identification and usage of the office supplies that are stored in the multiple storage containers, the work surface preferably is formed from a translucent material which allows the office worker to look downwardly therethrough. In this arrangement, the hook and loop material on the work surface also is translucent so that the office worker can look through the work surface and connector material to view the contents of the various storage containers. This permits ready identification of the office supplies and practically eliminates a manual search through multiple containers to locate the desired office supply. Instead, the office worker can readily locate the desired office supply visually, even when the office worker is leaning over the work surface, and can then grip the selected container for removal of the storage container from the work surface.

Other objects and purposes of the invention, and variations thereof, will be apparent upon reading the following specification and inspecting the accompanying drawings.

Figure 1:
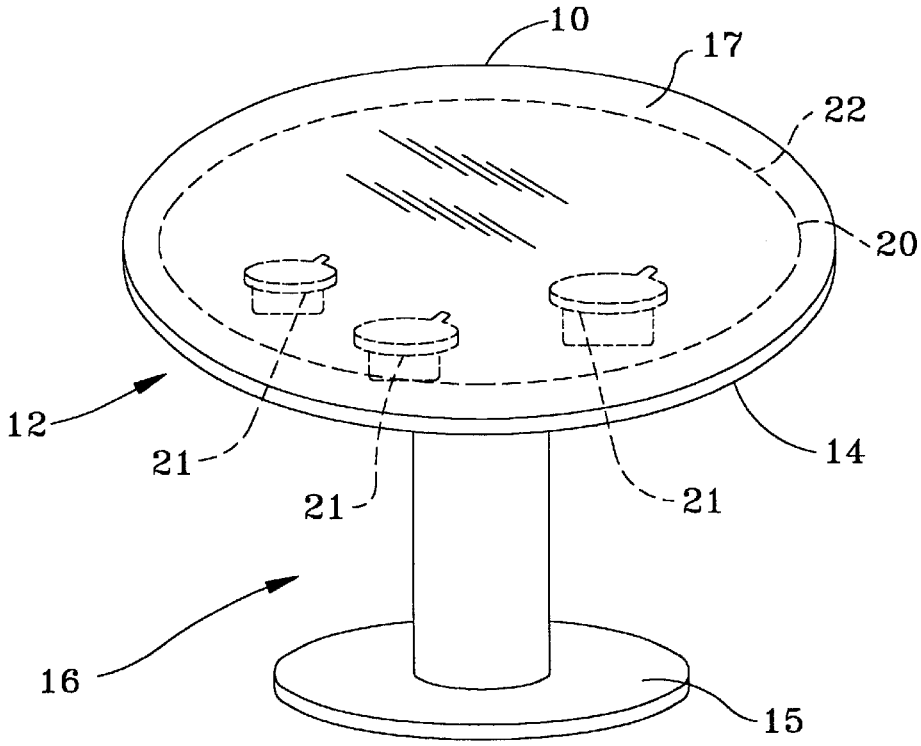
FIG.1 is a perspective view of a table arrangement having a work surface and a plurality of storage containers mounted thereon.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, a work surface 10 is illustrated having a storage system 12 mounted to a bottom face 14 thereof.

The work surface 10 is illustrated in a table configuration wherein the work surface 10 is supported on a freestanding base unit 15. The work surface 10 is disposed in vertically spaced relation relative to a floor surface on which the base unit 15 is positioned such that a knee space 16 is defined therebetween. It will be understood that the work surface 10 may also be formed in other configurations such as a wall-mounted configuration wherein the work surface 10 is hung or attached from a wall structure such as a space-dividing wall panel.

The work surface 10 is relatively thin in the vertical direction and defined by an upper face 17 and the bottom work surface face 14. Preferably, the work surface 10 is formed of a translucent material such as a transparent glass-like material to facilitate use of the storage system 12 as described in further detail herein.

The storage system 12 comprises a layer of connector material 20 which overlies and is secured to the bottom work surface face 14. The storage system 12 further includes a plurality of storage containers 21 which are removably suspended from the bottom work surface face 14 by interconnection with the connector material 20 to store various articles 18 and 19 therein.

Figure 2:
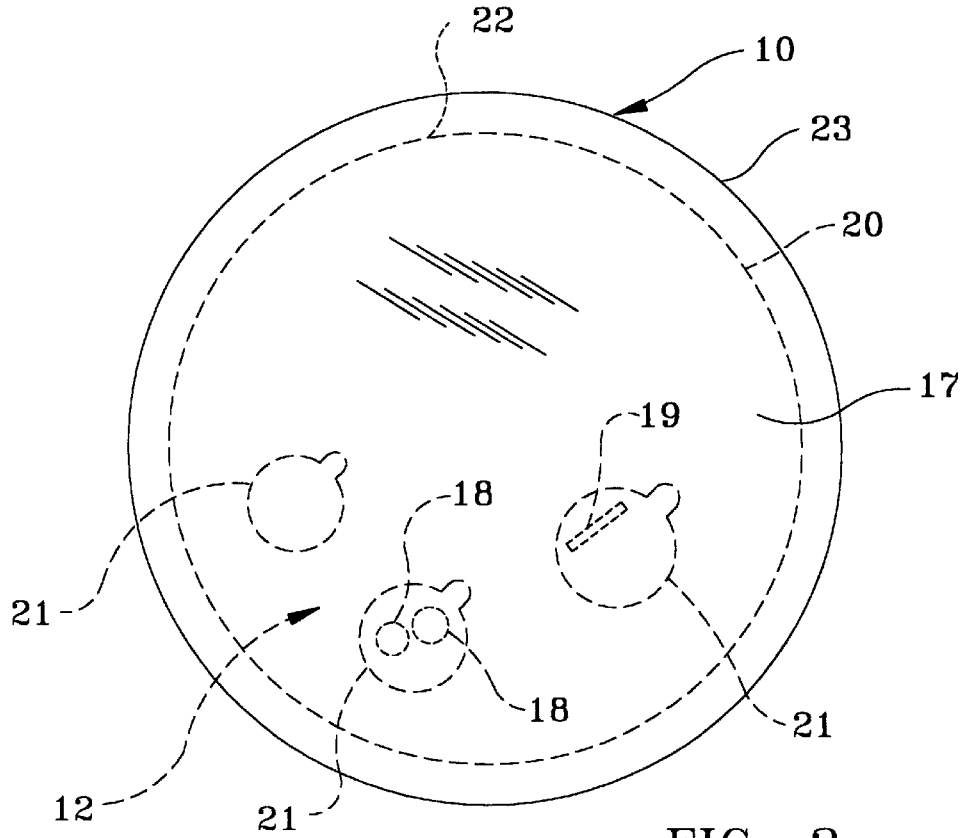
FIG. 2 is a plan view of the work surface and storage containers.
Figure 3:
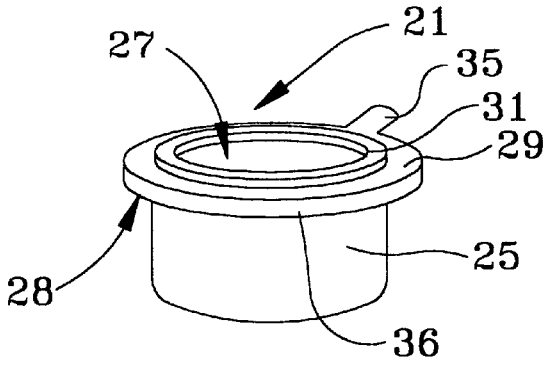
FIG. 3 is a perspective view of a representative one of the storage containers.

More particularly, the connector material 20 is illustrated diagrammatically in phantom outline in FIGS. 1 and 2. The connector material 20 is formed as a sheet of material that is secured to the bottom work surface face 14 by an adhesive. The connector material 20 may be secured in place by other alternate securement methods including fasteners and double sided tape.

The connector material 20 preferably is a hook and loop material designated commercially as Velcro™ and preferably covers substantially the entire area of the bottom face 14. As illustrated in FIG. 2, the outer peripheral edge 22 of the connector material 20 is spaced radially inwardly only a short distance from the outer circumferential edge 23 of the work surface 10.

As such, the connector material 20 therefor overlies the knee space 16 which is the space in which the knees of user move during normal work tasks. The connector material 20 also extends beyond the knee space 16 to define additional area outside of the knee space 16 in which the storage containers may be positioned. Thus, the containers 21 can be selectively positioned either in the knee space 16 or to the side of the knee space to provide additional clearance for the knees of the user.

Additionally, since the base unit 15 is located centrally of the work surface 10, the work surface 10 extends generally annularly about the base unit 15 to define multiple sides about the circumference of the work surface 10 at which the user may be seated. This provides flexibility for seating of the user since the user can move to any side of the work surface 10 and reposition the storage containers 21 adjacent to the new seating position.

While the connector material 20 has a circular shape which conforms to the circular shape of the work surface 10, the connector material 20 may also have alternate shapes. For example, where the work surface 10 has a non-circular shape, the connector material 20 may be shaped so as to also have a non-circular shape which corresponds to the shape of the work surface. Still further, the connector material 20 may be cut to a shape which differs from the work surface 10 so as to have an area which is significantly less than the area of the work surface 10. As a result, the connector material 20 may be used to form one or more predefined small areas to which the storage containers 21 may be mounted.

In addition to the work surface 10 being translucent, the connector material 10 preferably is also translucent to allow the office worker to look through the work surface 10 and the connector material 20 and be able to view the area disposed below the bottom work surface face 14. The connector material 20 does not need to be entirely clear but at least have sufficient translucency so as to permit recognition of the shapes of the stored articles which are disposed closely adjacent to the bottom face 14. Alternatively, the connector material 20 may also be opaque if the ability to view through the work surface 10 is not required or desired.

With respect to the storage containers 21, at least one and preferably a plurality of the storage containers 21 are provided. The storage containers 21 are adapted to be independently positioned and suspended from the work surface 10.

Each storage container 21 has an annular side wall 25 and a bottom wall 26 which are formed integrally together to thereby define an interior chamber 27. The side wall 25 extends upwardly from the bottom wall 26 and terminates at an annular upper rim 28. The rim 28 defines an open upper end for the interior chamber 27 such that various office supplies and other small articles 18 or 19 can be placed into and stored in the interior chamber 27.

Figure 4:
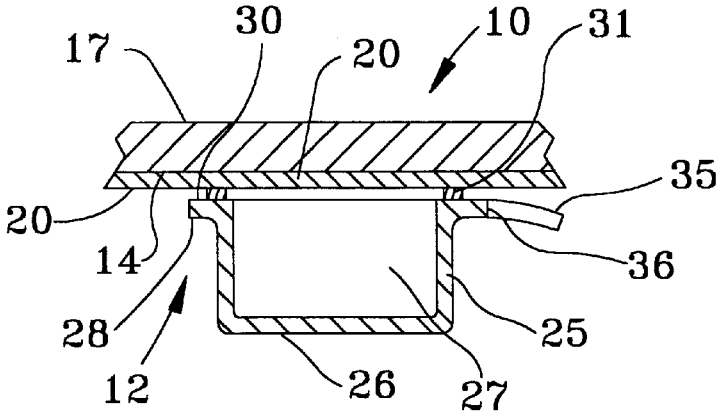
FIG. 4 is a partial side view in cross section illustrating a storage container mounted to a bottom face of the work surface.

To secure the storage containers 21 to the work surface 10, the upper rim 28 of each container 21 comprises a mounting flange or lip 29 which projects radially outwardly and includes an upward-facing flange surface 30. The flange surface 30 has a strip or band 31 of connector material affixed thereto wherein the connector material corresponds to and thereby is engagable with the connector material 20. Preferably, the connector material is a hook and loop material, i.e. Velcro™, whereby the connector strip 31 removably engages the connector material 20. The engagement of the connector strip 31 permit the storage containers 21 to be suspended from the work surface 10 as illustrated in FIG. 4.

Figure 5:
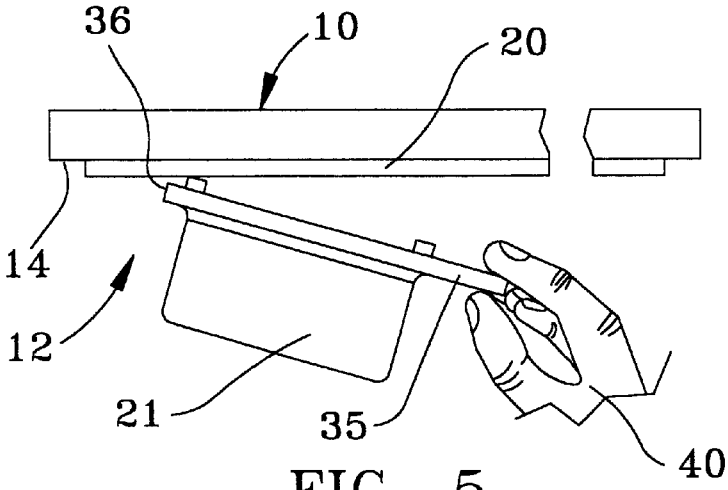
FIG. 5 is a diagrammatic view illustrating the storage container being removed from the work surface.

The mounting flange 29 further includes a tab 35 which projects radially from the outer edge 36 of the flange 29 in cantilevered relation therewith. The tab 35 is flexible and can be gripped manually by the hand 40 of the worker as illustrated in FIG. 5 to remove the storage container 21, for example, to access the contents of the storage container 21 or reposition the storage containers 21.

Preferably, the storage container 21 is formed of a translucent material which facilitates viewing of the contents of the storage container 21 by allowing light to pass therethrough.

In operation, the work surface 10 typically is located in an office area and has a seat associated therewith. Depending upon the location of the seat relative to the work surface 10, the office worker positions the storage containers 21 in any desired arrangement on the bottom work surface face 14. Typically, the storage containers 21 are positioned close to the seating area so as to be within arm's reach of the worker for accessibility.

The storage containers 21 are provided with various articles 18 or 19, such as erasers, paper clips, pens or the like which are stored within the interior chambers 27. It will understood that a variety of different small articles can be stored therein. Further, the storage containers 21 may be provided in different widths and depths as illustrated in FIG. 2 to vary the size of the chamber 27. While the containers 21 are illustrated as being circular when viewed from above, it will also be understood that the shape of the containers 21 may vary. For example, one or more of the containers may be rectangular.

Since the work surface 10 and connector material 20 are preferably translucent, the worker can readily look downwardly through these structures to view the contents of the storage containers 21 which are attached to the work surface 10. Once the desired contents are identified, the worker can reach under the work surface 10, grip the tab 35 and then pull downwardly to disengage the container 21 from the work surface 10 as seen in FIG. 5. The storage container 21 can then be returned to this original position or moved to any alternate position within the area of the connector material 20.

While the work surface 10 may be transparent in one embodiment, the work surface 10 also could be formed of a smoked glass-like material which reduces the noticeability of the storage containers 21 while still permitting viewing therethrough.

With the storage system of the invention, a readily reconfigurable storage system is provided whereby storage containers can be repositioned to any location within the area of the connector material 20. Further, the worker can readily identify the contents of the storage containers 21 visually through the work surface 10 and can avoid having to remove the containers 21 to identify the contents.

Although a particular embodiment of the invention has been disclosed in detail for illustrative purposes, it will be recognized that variations or modifications of the disclosed apparatus, including the rearrangement of parts, lie within the scope of the present invention.

What is claimed is:

1. A furniture arrangement comprising:

a horizontally elongate work surface having an upper surface defining a work area for a user and a lower surface, said lower surface defining a connector area that includes a connector material thereon which faces downwardly; and one or more storage containers, each having a wall with an upper end which defines an opening to provide access to a storage compartment within said storage container, said upper end including a connector material affixed to said wall which faces upwardly in opposing relation with said work surface connector material and is removably engageable with said work surface connector material by upward, non-rotating displacement of said storage container toward said lower surface, said storage containers being suspended from said lower surface of said work surface by engagement of said container connector material with said work surface connector material and being disengageable by downward displacement of said storage container to permit access to said storage container and repositioning of said storage container within said connector area.

2. A furniture arrangement comprising:

a horizontally elongate work surface having an upper surface defining a work area for a user and a lower surface, said lower surface defining a connector area that includes a connector material which faces downwardly; and a plurality of storage containers, each having an upper end which defines an opening to provide access to a storage compartment within said storage container, said upper end including a connector material which is removably engageable with said work surface connector material such that said storage containers are suspended from said lower surface of said work surface by engagement of said container connector material with said work surface connector material and are disengageable therefrom to permit access to said storage containers, said container connector material providing a self-adhering connection with said work surface connector material.

3. The furniture arrangement according to claim 2, wherein said work surface connector material and said container connector material are cooperating hook and loop materials.

4. A furniture arrangement comprising:

a horizontally elongate work surface having an upper surface defining a work area for a user and a lower surface, said lower surface including a layer of a connector material which faces downwardly and defines a connector area; and a plurality of storage containers, each having an upper rim which defines an opening to provide access to a storage compartment within said storage container, said upper rim including a connector material which is removably engageable with said work surface connector material, said storage containers being suspended from said lower surface of said work surface by engagement of said rim connector material with said work surface connector material and being disengageable to permit access to said storage container and repositioning of said storage container within said connector area, said upper rim of each said storage container including an outwardly projecting tab which is manually grippable when said storage container is engaged with said work surface to permit removal of said storage container therefrom.

5. A furniture arrangement comprising:

a horizontally elongate work surface having an upper surface defining a work area for a user and a lower surface, said lower surface including a layer of a connector material which faces downwardly and defines a connector area; and a plurality of storage containers, each having an upper rim which defines an opening to provide access to a storage compartment within said storage container, said upper rim including a connector material which is removably engageable with said work surface connector material, said storage containers being suspended from said lower surface of said work surface by engagement of said rim connector material with said work surface connector material and being disengageable to permit access to said storage container and repositioning of said storage container within said connector area;

said work surface and said work surface connector material being translucent to permit downward viewing of said interior compartment of each said storage container as viewed downwardly through said work surface.

6. The furniture arrangement according to claim 1, wherein office supplies are stored within one or more of said storage containers.

7. A work surface arrangement comprising:

a flat work surface having support structure which supports said work surface in vertically spaced relation from a floor to define a knee space for receiving knees of a user, said work surface including an upper surface which defines a work area for a user, and a lower surface which faces downwardly; and a storage system comprising a layer of work surface connector material affixed to said lower surface of said work surface wherein said connector material defines an enlarged connector area which faces downwardly, said storage system further including a plurality of storage containers, each said storage container having an interior storage compartment and an upper rim which defines an opening to permit access to said interior compartment, said upper rim including rim connector material disposed on an upward facing surface of said upper rim, said rim connector material being engageable with said work surface connector material such that said upper rim is disposed closely adjacent to said bottom surface of said work surface and said storage container is suspended downwardly therefrom, said rim connector material being engageable at any location within said connector area wherein said connector area is able to receive all of said storage containers therein.

8. The work surface arrangement according to claim 7, wherein said storage containers are supported within portions of said connector area and said connector area includes additional portions which permit repositioning of said storage containers to said additional portions.

9. The work surface arrangement according to claim 8, wherein said connector area has a shape which corresponds to a shape of said work surface.

10. The work surface arrangement according to claim 7, wherein said connector area includes a portion which overlies said knee space and an additional portion which extends outwardly of said knee space so that said storage containers may be positioned within said knee space or outside of said knee space.

11. The work surface arrangement according to claim 7, wherein said work surface connector material and said rim connector material are defined by cooperating hook and loop materials.

12. The work surface arrangement according to claim 7, wherein said work surface material and said rim material are defined by flexible materials which are engaged with each other upon contact between opposing surfaces thereof.

13. The work surface arrangement according to claim 7, wherein said support structure is located centrally within an interior region of said work surface such that said work surface is accessible from multiple sides thereof, said work surface connector material being positioned within said multiple sides to define multiple locations at which a user may be seated adjacent the work surface wherein said storage containers may be positioned for access relative to any of said multiple sides.

14. A work surface arrangement comprising:

a work surface having a support structure which supports said work surface in vertically spaced relation from a floor to define a knee space for receiving knees of a user, said work surface including an upper surface which defines a work area for a user, and a lower surface which faces downwardly and defines an upper boundary of said knee space; and a storage system comprising a layer of work surface connector material affixed to said lower surface wherein said connector material defines an enlarged connector area which faces downwardly, said storage system further including a plurality of storage containers wherein each said storage container has an interior storage compartment and an upward facing upper surface which faces towards said lower surface, said storage container having an opening to permit access to said interior compartment and permit storage of articles therein, said upper surface including container connector material which is engageable with said work surface connector material such that said storage container is suspended downwardly from said work surface and said container connector material is engageable at any location within said connector area, said connector area including portions in which all of said storage containers may be suspended and additional portions which permit repositioning of said storage containers to said additional portions, said work surface having multiple side sections wherein a user may be seated at any one of said side sections and said storage containers are movable adjacent to any of said side sections to permit access by the user.

15. The work surface arrangement according to claim 14, wherein each said storage container includes an upper rim which defines said upper surface having said container connector material thereon and defines said opening to permit access to said interior compartment.

16. The furniture arrangement according to claim 15, wherein said opening opens upwardly toward said work surface connector material when suspended therefrom, said work surface and said work surface connector material being translucent to permit viewing of said interior compartment of each said storage container from an area disposed above said work surface.

17. The work surface arrangement according to claim 14, wherein said support structure is disposed radially inwardly of each of said multiple sides of said work surface.

18. The work surface arrangement according to claim 17, wherein said multiple sides are disposed outwardly of and extend about the periphery of said support structure.

19. The work surface arrangement according to claim 14, wherein said upper surface of each said storage container includes an outwardly projecting tab which is manually grippable when said storage container is engaged with said work surface to permit removal of said storage container therefrom.

20. The work surface arrangement according to claim 14, wherein each said storage container includes an upper rim which defines said upper surface of said storage container and defines said opening into said interior compartment, each said storage container having a side wall wherein said upper rim projects radially outwardly of said side wall.

* * * * *